US009924575B2

(12) United States Patent
Ma et al.

(10) Patent No.: US 9,924,575 B2
(45) Date of Patent: Mar. 20, 2018

(54) DIMMING CIRCUIT FOR DIGITAL CONTROL

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Xuhong Ma, Zhejiang (CN); Junjun Ying, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 15/380,683

(22) Filed: Dec. 15, 2016

(65) Prior Publication Data

US 2017/0196065 A1 Jul. 6, 2017

(30) Foreign Application Priority Data

Dec. 31, 2015 (CN) ..... 2015 1 1023161

(51) Int. Cl.
*H05B 37/02* (2006.01)
*H05B 33/08* (2006.01)

(52) U.S. Cl.
CPC ..... *H05B 33/0851* (2013.01); *H05B 33/0815* (2013.01); *H05B 33/0845* (2013.01); *H05B 33/0857* (2013.01)

(58) Field of Classification Search
CPC ..... H05B 33/0815; H05B 33/0845; H05B 33/0857
USPC ..... 315/307
See application file for complete search history.

(56) References Cited

U.S. PATENT DOCUMENTS 6,501,236 B1 * 12/2002 Smith ..... H05B 39/047 315/224
2013/0076246 A1 * 3/2013 Okawa ..... H05B 33/0896 315/121
2014/0152182 A1 * 6/2014 Yamamoto ..... H05B 33/0815 315/122
2014/0184103 A1 * 7/2014 Kim ..... H05B 33/0851 315/307
2014/0320031 A1 * 10/2014 Wu ..... H05B 33/0812 315/193
2014/0327366 A1 * 11/2014 Wu ..... H05B 33/0815 315/200 R
2016/0111955 A1 * 4/2016 Hwang ..... H02M 3/156 323/235

* cited by examiner

*Primary Examiner* — Tung X Le
(74) *Attorney, Agent, or Firm* — Wang Law Firm, Inc.

(57) ABSTRACT

A dimming circuit for digital control includes two output terminals, a voltage sampling unit, an error amplifier unit, and an impedance transforming unit. The MCU voltage generating unit configured for setting the output voltage of the dimming circuit. The error amplifier unit is configured for comparing the voltage value between the two output terminals with the output voltage set by the MCU voltage generating unit. The impedance transforming is configured for adjusting the resistance value thereof according to the output of the error amplifier unit so as that the output voltage value of the dimming circuit for digital control is equal to the output voltage value set by the MCU voltage generating unit. While using the MCU voltage generating unit under programming of the user, the dimming circuit 100 can automatically perform the output of the LED lamp required by the user.

9 Claims, 5 Drawing Sheets

DIMMING CIRCUIT FOR DIGITAL CONTROL

RELATED APPLICATION

This present application claims benefit of the Chinese Application, CN201511023161.3, filed on Dec. 31, 2015.

BACKGROUND

1. Technical Field

The present application relates to lighting equipment, and more particularly to a digital dimming circuit.

2. Description of the Related Art

Light emitting diode (LED) is growing in popularity due to decreasing costs and long life compared to incandescent lighting and fluorescent lighting. LED lighting can also be dimmed without impairing the useful life of the LED light source.

Recently, a number of LED lighting apparatuses have been designed to replace the halogen apparatus, as well as other traditional incandescent or fluorescence lighting apparatuses. As in the use of different lighting environment, or in the same lighting environment the light intensity of the light is different, it is needed to adjust the LED light intensity. Therefore, it is needed to adjust the output power of the drive power of the LED lighting apparatuses by dimmers. Usually, there are two ways to dim, one is directly connected to a resistance, and the other is to manually adjust via a potentiometer.

About the way of direct connection of the resistance, it is a most simple and most direct way. However, there are the most problems as the different drive powers of the different manufacturers have on the different output current value during the 1-10 volts. Therefore, when the selected potentiometer is not appropriate the LED lighting apparatuses may have a large dimming dead zone, or it is difficult to be up to the maximum dimming brightness. Moreover, for 1-10V dimming system, it is usually connected a number of drive powers in parallel. As a result, only the potentiometer is almost impossible to play a role of adjustment. Because when multiple power supplies are connected in parallel to the 1-10V dimming system and multiple LED lamps are connected to the power supplies respectively, the brightness of each of the LED lamp is reduced, i.e., below the brightness when only one LED lamp is connected to the dimming system. For another way, it is realized by adjust the voltage value of the voltage divider resistor via a triode with the potentiometer. As above mentioned, the potentiometers are used in these two methods to achieve dimming. However, with the intelligent development, it uses more and more interactive interface and it cannot be resolved only via the potentiometer as it always need to manually operate. Therefore, it began to use the MCU (Microcontroller Unit) to load the desired output voltage into 1-10 V dimming general route.

Therefore, it is necessary to provide a digital dimming circuit which use the MCU to settle out the above art problem.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout two views.

DETAILED DESCRIPTION

The present application is illustrated by way of example and not by way of limitation in the figures of the accompanying drawings. It should be noted that references to "an" or "one" embodiment in this application are not necessarily to the same embodiment, and such references mean at least one.

Figure 1:
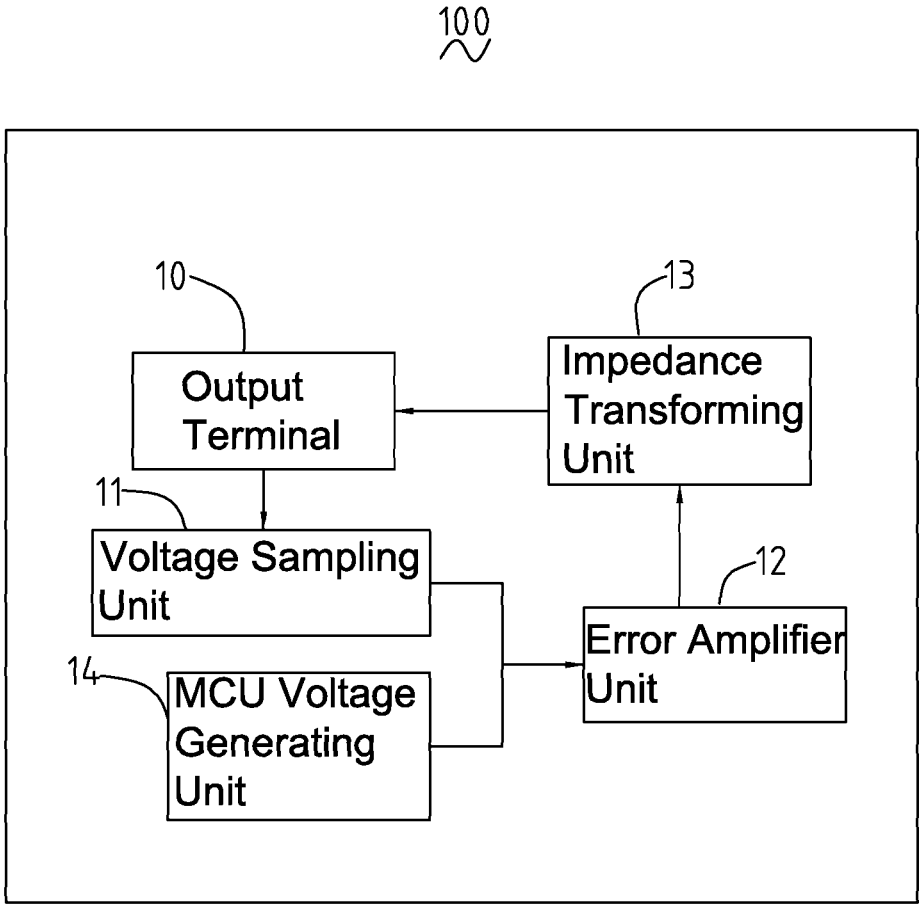
FIG. 1 is a block diagram of a digital dimming circuit according to an embodiment.
Figure 2:
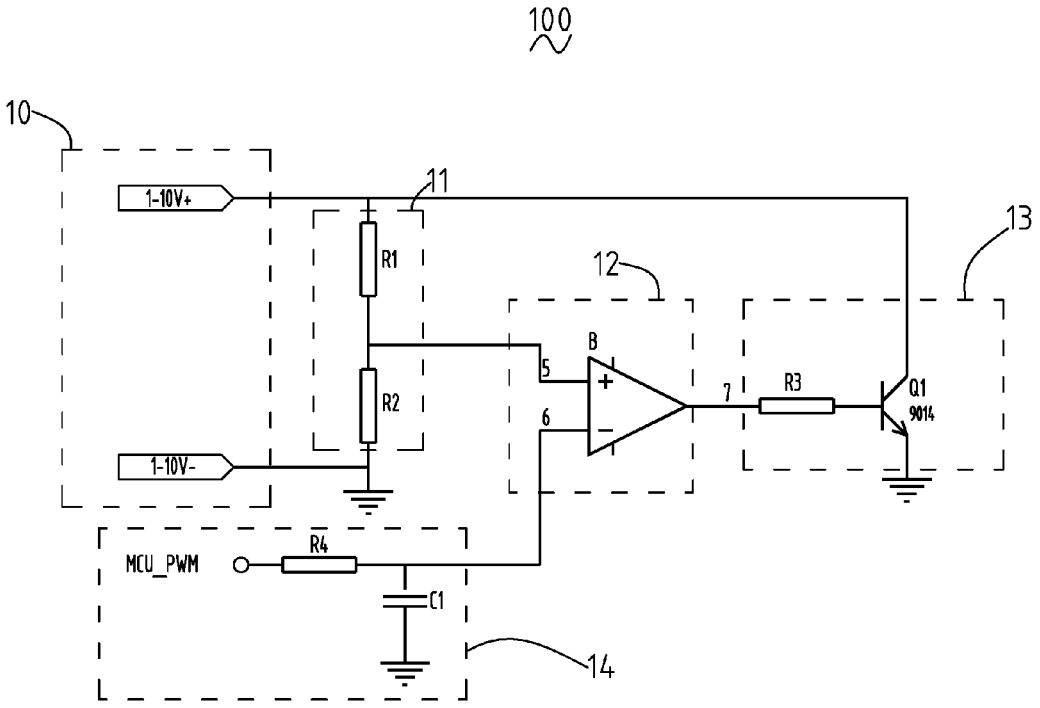
FIG. 2 is one of circuit diagrams of the digital dimming circuit of FIG. 1 according to a first embodiment.
Figure 3:
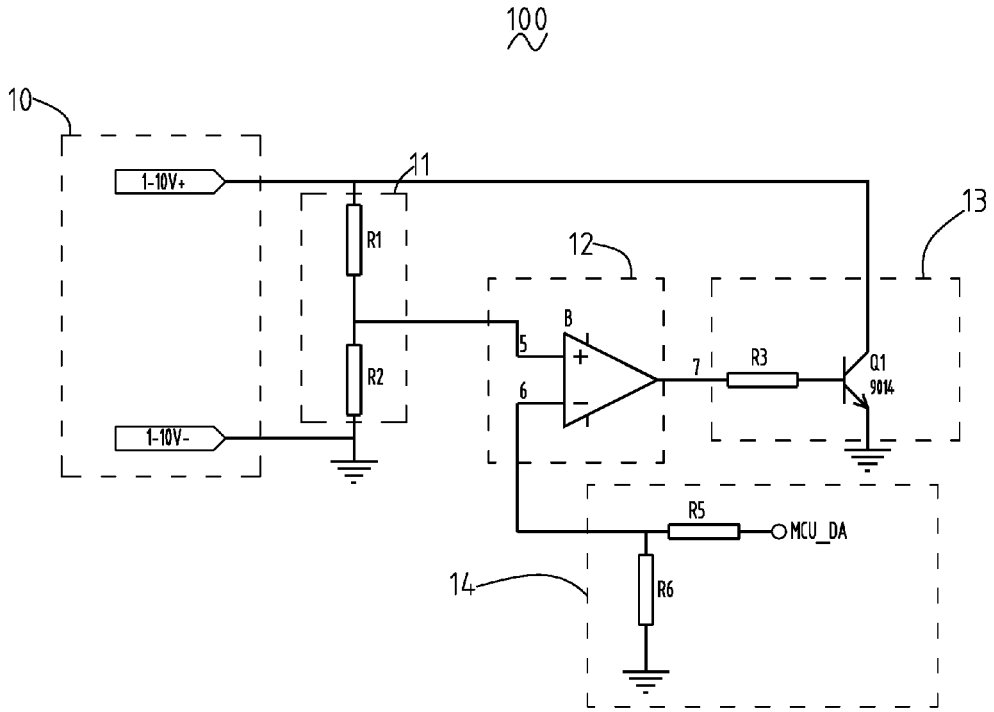
FIG. 3 is another of circuit diagrams of the digital dimming circuit of FIG. 1 according to the first embodiment.

Referring to FIG. 1-FIG. 3, a block diagram and circuit diagrams of a digital dimming circuit 100 according to a first embodiment are shown. The digital dimming circuit 100 includes two output terminals 10, a voltage sampling unit 11 electrically connected between the two output terminals 10, an error amplifier unit 12 electrically connected to the voltage sampling unit 11, an impedance transforming unit 13 electrically connected to output ends of the error amplifier unit 12, and a MCU voltage generating unit 14 electrically connected to an input end of the error amplifier unit 12. The digital dimming circuit for digital control 100 is applied to adjust the output power of a drive power which is supplied for an LED lamp. Therefore, the two output terminals 10 are electrically connected to the drive power, and the drive power is electrically connected to the LED lamp so as to provide compliance power for the LED lamp.

The two output terminals 10 may have different connecting way depending on the different application. For example, in a wired controlled drive power supply, the two output terminals 10 may include two wires. And in a wirelessly controlled drive power supply, the two output terminals 10 may be a transmitting device, such as Bluetooth, DALI, infrared, and so on. In the first embodiment, only for illustrating the structure and operation principle of the present invention, the two output terminals 10 includes two wires. The two wires may be electrically connected directly to the drive power so as to control the output power thereof. It will be appreciated that the output terminals 10 should also be known to a person skilled in the art and will not be described in detail herein since the bluetooth, DALI, and infrared are prior art.

The voltage sampling unit 11 is configured for sampling the output voltage of the two output terminals 10 and includes two resistors R1, R2 connected in series between said two output terminals 10. The voltage between the two output terminals 10 is known by collecting the voltage divided into the resistor R1 or R2.

The error amplifier unit 12 may include an operational amplifier, and is configured for receiving and comparing the voltage values transmitted from the voltage sampling unit 11 and the MCU voltage generating unit 14. And then the error amplifier unit 12 amplifies the compared difference and transmits the amplified value to the impedance transform Unit 13. In the first embodiment, the non-inverting input terminal of the error amplifier unit 12 is electrically connected between the two resistors R1, R2 of the voltage sampling unit 11 to collect the voltage value between the two output terminals 10. The inverting input terminal of the error amplifier unit 12 is electrically connected with the MCU voltage generating unit 14 to receive voltage value which is output therefrom and set by a user. Operational amplifiers are well known to a person skilled in the art as an element of the present invention and need not be described in detail. The operational amplifier compares the voltage from the voltage sampling unit 11 and the MCU voltage generating unit 14 and makes a difference, and then outputs the difference to the output terminal thereof.

The impedance transforming unit 13 includes a resistor R3 and an NPN-typed triode Q1 electrically connected with the resistor R3. The NPN-typed triode Q1 is configured for adjusting the resistance value thereof in accordance with the output of the error amplifier unit 12 so as that the output voltage value of the dimming circuit for digital control 100 is equal to the output voltage value set by the MCU voltage generating unit 14. The resistor R3 is electrically connected between the error amplifier unit 12 and the triode Q1 for protecting the triode Q1. A base of the triode Q1 is electrically connected with the resistor R3, a collector is electrically connected to one of the two output terminals 10, and the emitter is grounded. As shown in FIG. 2, the operation principle of the impedance conversion unit 13 will be explained in detail. The impedance transforming unit 13 will be activated in two cases, one is that a plurality of drive powers are increased or decreased in the entire lighting circuit, i.e., the LED lamps in the lighting circuit are increased or decreased, and in the other case the output voltage value set by the MCU voltage generating unit 14 is changed, that is, increased or decreased. In both cases, the operation principle of the impedance conversion unit 13 is the same, and therefore, it will be described here only by adding a plurality of drive powers to the entire lighting circuit as an example. Assuming that the current value flowing through the CE electrode of the triode Q1 is $I_c$, and the current value flowing through the BE electrode is $I_b$, $I_c$ is well known to the triode for $I_c$ being proportional to $I_b$, that is to say, $I_c=\beta I_b$. Assuming that the impedance between the CE electrode of triode Q1 is $R_{ce}$ and the voltage value therebetween is $U_{ce}$, therefore, $R_{ce}=U_{ce}/I_c=U_{ce}/\beta I_b$. The $I_c$ flowing into the dimming circuit 100 will increase when the plurality of drive powers increases into the entire lighting circuit so that $U_{ce}$ will increase. Therefore, the voltage value at the non-inverting input terminal of the error amplifier unit 12 will increase via sampling the output voltage of the two output terminal 10 by the voltage sampling unit 11. And the voltage value at the inverting input terminal connected to the MCU voltage generating unit 14 does not change. Therefore, the voltage difference Δ U between the input terminals of the error amplifier unit 12 will increase. In result, the voltage value $U_c$ at the output terminal of the error amplifier unit 12 will increase. In addition, the voltage value Uc is the output voltage value, for example, 1000 times amplified by the error amplifier unit 12. Therefore, the voltage value Uc after being amplified relates to voltage value $U_{ce}$, the $U_{ce}$ can be considered no change, that is to say, it not be adjusted. And $I_b=(U_c-0.7)/R3$, so $I_b$ will increase. Since $R_{ce}=U_{ce}/I_b=U_{ce}/I_b$, the $R_{ce}$ will be reduced. As a result, the purpose of adjusting can be achieved. Since $R_{ce}$ decreases, and $U_{ce}$ can be reduced, so that the output of the dimming circuit 100 remains unchanged. Therefore, even when a plurality of power supplies are connected in parallel to the dimming circuit 100 and one LED lamp is connected to each of the power supply, the luminance of each lamp does not decrease when the output of the adjustment circuit 100 is kept constant, i.e., when the brightness of only one lamp it's the same. Similarly, when the output voltage of the MCU voltage generating unit 14 is changed, for example, it is increased, as described above, the $R_{ce}$ increases so that the $U_{ce}$ is increased correspondingly. As a result, the output of the adjustment circuit 100 is kept constant.

The signal generated by the MCU voltage generation unit 14 may be a PWM signal or a DA signal. When the signal generated by the MCU voltage generating unit 14 is a PWM signal, the MCU voltage generating unit 14 includes a resistor R4, a capacitor C1, and a PWM signal generator. The resistor R4 is connected in series between the PWM signal generator and the error amplifier unit 12, and the capacitor C1 is electrically connected between the resistor R4 and ground. When the signal generated by the MCU voltage generating unit 14 is a DA signal, the MCU voltage generating unit 14 includes two resistors R5, R6 and a DA signal generator. The two resistors R5 and R6 are connected in series between the DA signal generator and ground, and the inverting input terminal of the error amplifier 12 is electrically connected between the two resistors R5 and R6. The PWM signal generator and the DA signal generator are MCU, which is a micro-control unit and can be programmed by the user. In operation, it may output same or different voltage value at different times according to the pre-set value by the user. It will be understood that when the MCU voltage generating unit 14 outputs the same voltage setting value, it means that it has no desire to adjust the output of the LED lamp such as brightness, color, etc., and when different voltage setting values are output, it means that it need to adjust the output of the LED lamps. In the first embodiment, the signal generated by the MCU voltage generating unit 14 is a PWM signal. It is to be understood that the PWM signal generator and the DA signal generator, as a device known to those skilled in the art, need not be explained in detail herein.

By comparing the voltage in the dimming circuit 100 with the set voltage by the error amplifier unit 12, a negative feedback loop is formed and the stability of the entire circuit is improved. While using the MCU voltage generating unit 14 under programming of the user, the dimming circuit 100 can automatically perform the output of the LED lamp required by the user.

Figure 4:
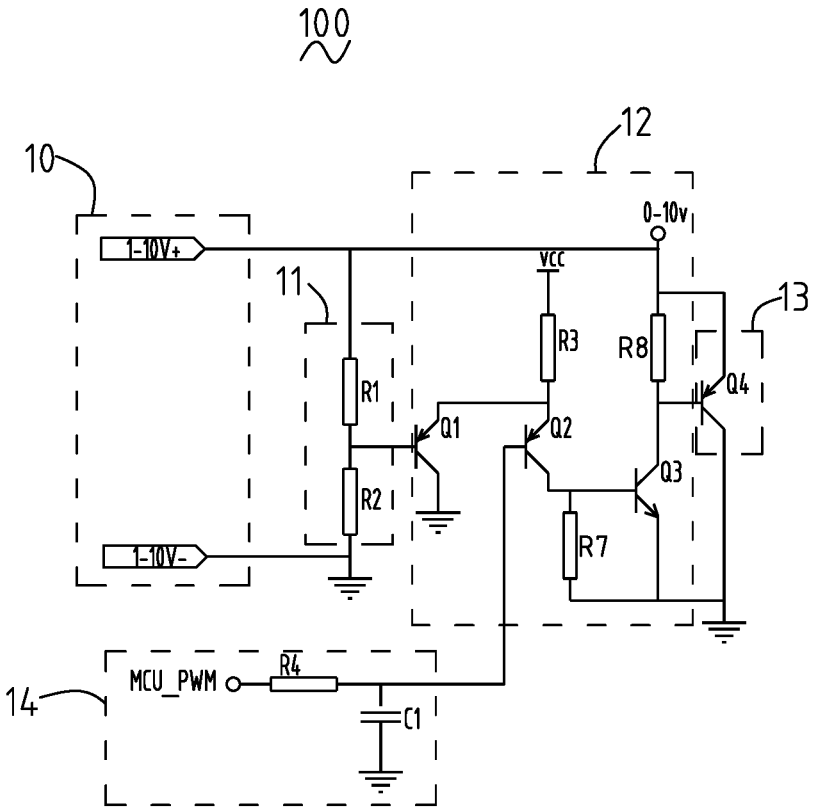
FIG. 4 is one of circuit diagrams of the digital dimming circuit of FIG. 1 according to a second embodiment.
Figure 5:
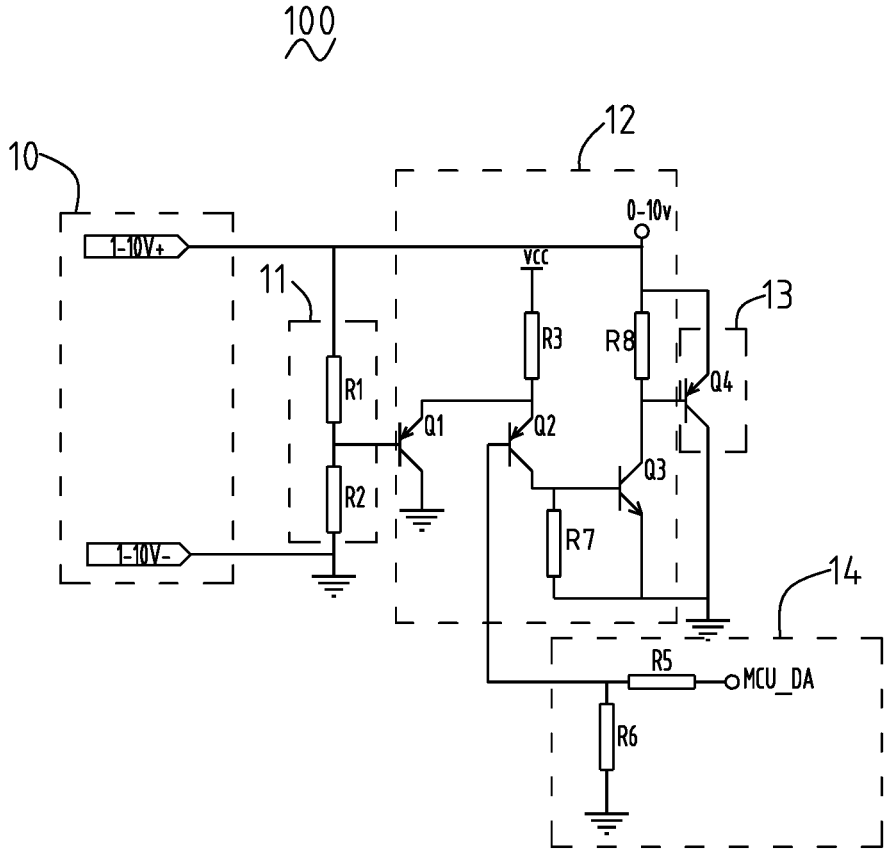
FIG. 5 is another of circuit diagrams of the digital dimming circuit of FIG. 1 according to the second embodiment.

Referring to FIG. 4 and FIG. 5, circuit diagrams of a dimming circuit for digital control 200 according to a second embodiment are shown. The dimming circuit for digital control 200 includes two output terminals 20, a voltage sampling unit 21 electrically connected between the two output terminals 20, an error amplifier unit 22 electrically connected to the voltage sampling unit 21, an impedance transforming unit 23 electrically connected to output ends of the error amplifier unit 22, and a MCU voltage generating unit 24 electrically connected to an input end of the error amplifier unit 22.

The second embodiment differs from the first embodiment only in that the error amplifier unit 22 differs from the circuit of the error amplifier unit 12. The error amplifier unit 22 of the second embodiment is composed of an analog circuit. The error amplifier unit 22 includes three triode Q1, Q2, Q3 and three resistors R3, R7, R8. One end of the resistor R3 is electrically connected with the emitters of the triode Q1 and Q2 and another end is electrically connected with the power supply end Vcc of the whole dimming circuit 200. The base of the triode Q1 is electrically connected with the voltage sampling unit 21, and the collector the triode Q1 is grounded. The base of the triode Q2 is grounded and the collector of the triode Q2 is electrically connected with the base of the triode Q3. The resistor R1 is electrically connected between the base of the triode Q3 and the ground. One end of the resistor R2 is electrically connected with one of the two output terminal 10 and another end of the resistor R2 is electrically connected to the collector of the triode Q3. The emitter of the triode Q3 is grounded.

The impedance transforming unit 23 includes a PNP-typed triode. The base of the PNP-typed triode is electrically connected with the collector of the triode Q3, the emitter of the PNP-typed triode is electrically connected with one of the two output terminals 20, and the collector of the PNP-typed triode is grounded. The operation principle of the impedance transforming unit 23 is the same as that of the impedance transforming unit 13, and will not be described here.

While the disclosure has been described by way of example and in terms of exemplary embodiment, it is to be understood that the disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A digital dimming circuit, comprising:

two output terminals;

a voltage sampling unit electrically connected between the two output terminals, the voltage sampling unit configured for sampling a voltage value between the two output terminals;

an error amplifier unit electrically connected the voltage sampling unit;

an impedance transforming unit electrically connected to output ends of the error amplifier unit; and a MCU (Microcontroller Unit) voltage generating unit electrically connected to input ends of the error amplifier unit, the MCU voltage generating unit configured for setting an output voltage of the digital dimming circuit, wherein the error amplifier unit is configured for comparing the voltage value between the two output terminals with the output voltage set by the MCU voltage generating unit, the impedance transforming unit comprises an NPN-typed triode (Q1) and is configured for adjusting a resistance value of the NPN-typed triode (Q1) according to an output value of the error amplifier unit so as that the output voltage value of the digital dimming circuit is equal to the output voltage value set by the MCU voltage generating unit.

2. The digital dimming circuit as claimed in claim 1, wherein the voltage sampling unit comprises two resistors connected in series between said two output terminals, the error amplifier unit is electrically connected between the two resistors.

3. The digital dimming circuit as claimed in claim 1, wherein the error amplifier unit comprises an operational amplifier, a non-inverting input terminal of the operational amplifier is electrically connected with the voltage sampling unit, an inverting input terminal of the operational amplifier is electrically connected with the MCU voltage generating unit, an output of the operational amplifier is electrically connected with the impedance transforming unit.

4. The digital dimming circuit as claimed in claim 3, wherein the impedance transforming unit comprises a resistor, the resistor is electrically connected between the error amplifier unit and the NPN type triode, the base of the NPN type triode is electrically connected with the resistor, the collector of the NPN type triode is electrically connected to one of the two output terminals, and the emitter of the NPN type is grounded.

5. The digital dimming circuit as claimed in claim 1, wherein a voltage signal generated by the MCU voltage generating unit is a PWM signal or a DA (Digital/Analog) signal.

6. The digital dimming circuit as claimed in claim 1, wherein a voltage signal generated by the MCU voltage generating unit is a PWM signal, the MCU voltage generating unit comprises a resistor, a capacitor, and a PWM signal generator, the resistor is electrically connected in series between the PWM signal generator and the error amplifier unit, the capacitor is electrically connected between the resistor and the ground.

7. The digital dimming circuit as claimed in claim 1, wherein a voltage signal generated by the MCU voltage generating unit is a DA (Digital/Analog) signal, the MCU voltage generating unit comprises two resistors, and a DA signal generator, the two resistors is electrically connected in series between the DA signal generator and ground, one of the input terminals of the error amplifier unit is electrically connected between the two resistors.

8. The digital dimming circuit as claimed in claim 1, wherein the error amplifier unit is composed of an analog circuit, and comprises three triodes (Q1, Q2, Q3) and three resistors (R1, R2 and R3), one end of the resistor (R3) is electrically connected to the emitters of the triode (Q1) and the triode (Q2), another end of the resistor (R3) is electrically connected to a power supply end, a base of the triode (Q1) is electrically connected with the voltage sampling unit, the collector of the triode (Q1 is grounded, a base of the triode (Q2) is grounded, a collector of the triode (Q2) is electrically connected to a base of the triode (Q3), the resistor (R1) is electrically connected in series between the base of the triode (Q3) and ground, one end of the resistor (R2) is electrically connected to one of the output terminals, the other end of the resistor (R2) is electrically connected to the collector of the triode (Q3), the emitter of the triode (Q3) is grounded.

9. The digital dimming circuit as claimed in claim 8, wherein the impedance transforming unit comprises a PNP-typed triode, a base of the PNP-typed triode is electrically connected to the collector of the triode (Q3), a emitter of the PNP-typed triode is electrically connected to one of the two output terminals, and the collector of the PNP-typed triode is grounded.

* * * * *